US005143007A

United States Patent [19]

Laukien et al.

[11] Patent Number: 5,143,007

[45] Date of Patent: Sep. 1, 1992

[54] METHOD OF OPERATING SUBMERGED SUBMARINES AND SUBARINE

[75] Inventors: Gunther Laukien, Silberstreifen, D-7512 Rheinstetten-Forchheim; Arne Kasten, Karlsruhe, both of Fed. Rep. of Germany

[73] Assignee: Gunther Laukien, Rheinstetten-Forcheim, Fed. Rep. of Germany

[21] Appl. No.: 602,317

[22] PCT Filed: Mar. 16, 1990

[86] PCT No.: PCT/DE90/00194

§ 371 Date: Nov. 15, 1990

§ 102(e) Date: Nov. 15, 1990

[87] PCT Pub. No.: WO90/10575

PCT Pub. Date: Sep. 20, 1990

[30] Foreign Application Priority Data

Mar. 16, 1989 [DE] Fed. Rep. of Germany ..... 3908574

[51] Int. Cl.[5] ..... B63G 8/34

[52] U.S. Cl. ..... 114/15; 114/270; 114/312; 367/1

[58] Field of Search ..... 114/15, 270, 312; 367/1; 89/36.01, 36.12

[56] References Cited

U.S. PATENT DOCUMENTS

| | | | |
|---|---|---|---|
| 2,395,944 | 3/1946 | Smith | 89/36.12 |
| 3,483,132 | 12/1969 | Bernd | 367/1 |
| 3,507,086 | 4/1970 | McGann et al. | 367/1 |
| 3,771,115 | 11/1973 | McLinden | 114/270 |
| 3,841,219 | 10/1974 | Schillreff | 367/1 |
| 4,969,399 | 11/1990 | Kish | 367/1 |

*Primary Examiner*—Sherman Basinger
*Assistant Examiner*—Thomas J. Brahan
*Attorney, Agent, or Firm*—Rosenblum, Parish & Isaacs

[57] ABSTRACT

A method for operating submerged submarines and a submarine are disclosed which are used to camouflage submerged submarines which, while submerged and travelling, draw a trail of heated cooling water behind themselves. In order to reduce the risk of detection of such submerged submarines by means of heat-sensitive detectors, either the density of the heated cooling water is increased through the introduction of additives, or, the heated cooling water is brought, by mechanical means, to a depth far below the submarine for preventing heated-up cooling water to rise up to the sea surface.

26 Claims, 4 Drawing Sheets

METHOD OF OPERATING SUBMERGED SUBMARINES AND SUBARINE

Figure 1:
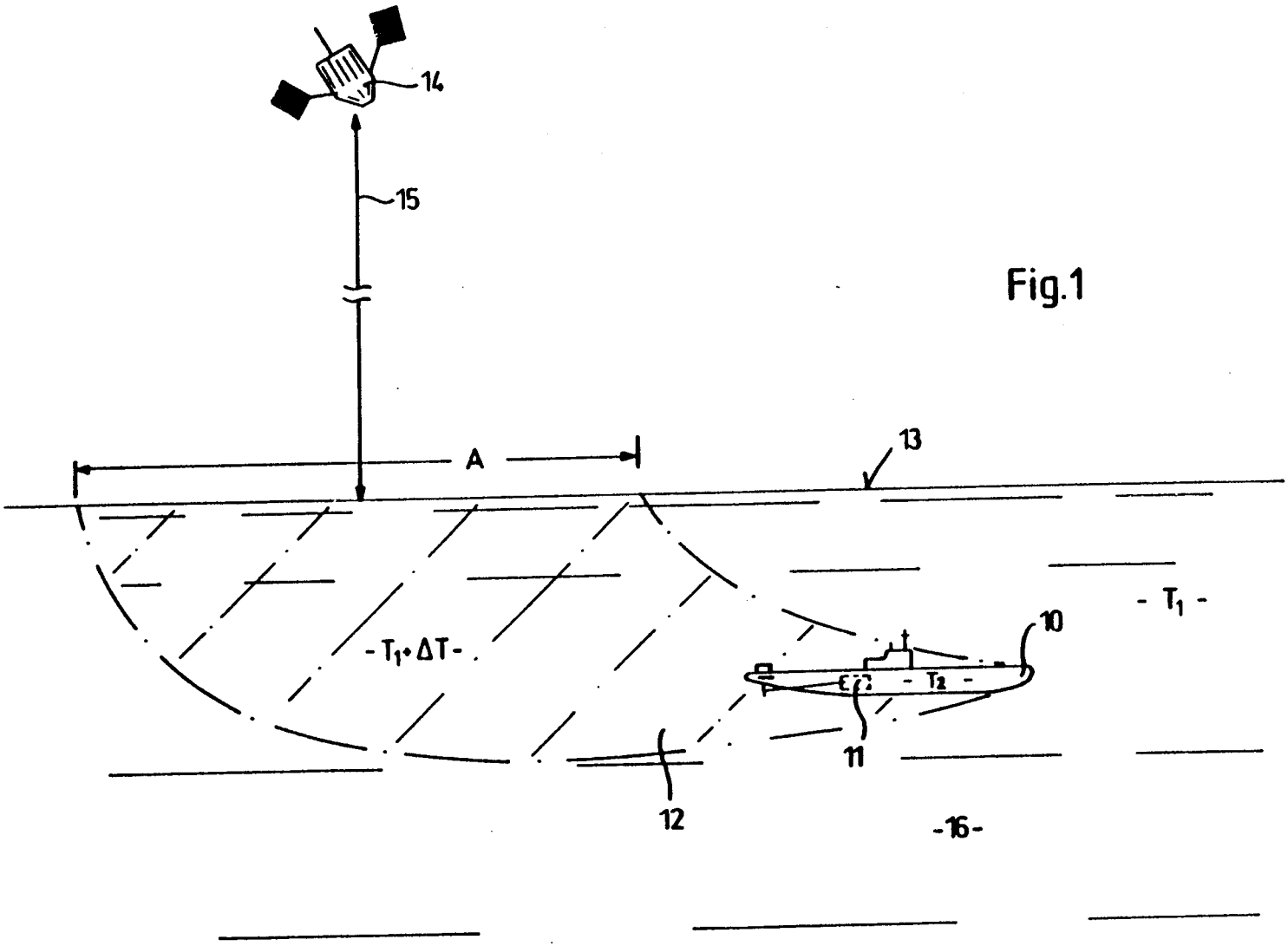

The invention relates to a method to operate submerged submarines, wherein cooling water is heated up during operation and emitted to the surrounding sea.

The invention is further related to a submarine heating cooling water during operation and emitting it to the surrounding sea.

This application is related to the following co-pending U.S. applications Ser. Nos. filed Nov. 15, 1990:

1) U.S. patent application entitled "METHOD FOR INFLUENCING AN ACOUSTIC SOURCE, IN PARTICULAR OF A SUBMERGED SUBMARINE, AND SUBMARINE", Ser. No. 614,300, filed Nov. 15, 1990, corresponding to International Application PCT/DE 90/00197;
2) U.S. patent application entitled "METHOD AND APPARATUS FOR REDUCING ACOUSTIC EMISSION FROM SUBMERGED SUBMARINES", Ser. No. 602,310, filed Nov. 15, 1990, corresponding to International Application PCT/DE 90/00192;
3) U.S. patent application entitled "METHOD AND APPARATUS FOR LOCALIZING SUBMARINES", Ser. No. 615,423, filed Nov. 15, 1990, corresponding to International Application PCT/DE 90/00193;
4) U.S. patent application entitled "UNDERWATER VEHICLE WITH A PASSIVE OPTICAL OBSERVATION SYSTEM", Ser. No. 602,319 filed Nov. 15, 1990, corresponding to International Application PCT/DE 90/00196;
5) U.S. patent application entitled "METHOD AND APPARATUS FOR REDUCING ACOUSTIC EMISSION FROM SUBMERGED SUBMARINES", Ser. No. 614,200, filed Nov. 15, 1990, corresponding to International Application PCT/DE 90/00195; and
6) German Patent Application P3908573.2 entitled "METHOD AND APPARATUS FOR OPERATING SUBMERGED SUBMARINES".

In particular, the submarines should be camouflaged using the invention.

It is known in the art, to locate submerged submarines in different ways. In doing this, one distinguishes between so-called "active" and "passive" localization methods. In the "active localization methods", a search signal is emitted from on board the searching vehicle, for example a frigate, e.g. an ultrasonic signal and the presence as well as, if need be, the position of the submerged submarine is detected using the signals reflected by the submarine. On the other hand, the "passive" localization methods use a perturbation of the environment which is caused by the submarine in its surroundings. For example, this perturbation of the environment can consist of a perturbation of the earth's magnetic field or in superposition of the natural environmental noise upon noise characteristic of the submarine.

Each of the localization methods mentioned above has its own specific disadvantages. A common disadvantage of these methods is the fact that localizing submerged submarines becomes more difficult the larger the distance between submarine and search vehicle. It is well known in the art, to locate submarines from on board aircraft by towing an extremely sensitive magnetic probe (nuclear magnetic probe) on a long line behind the aircraft, whereby the perturbations of the earth's magnetic field caused by the submarine are detected. However, also this localization method soon reaches its limits, actually all the more, the more modern submarines of non-magnetic steel are manufactured. Moreover, a reasonably precise localization of the submerged submarine is also only possible with this method after flying several times cross-wise over a certain region of the sea.

Since submarines are driven by motors, a certain amount of lost heat is always produced, whose amount depends on the type of propulsion of the submarine and on the propulsion power actually used, and so on.

In general, in order to cool the drive system, submarines are equipped with a cooling system whereby the lost heat of the drive system is emitted to the surrounding sea water. For example, it is known in the art, to direct conduits of an internal cooling circuit of the drive along outside the outer hull of the submarine, in order that during navigating the submarine the surrounding cold sea water sweeps along these conduits and draws heat off these conduits.

Moreover, other elements of the submarine, in particular an indoor heating and such, produce a considerable heat loss which is given off via the entire outer hull of the submarine to the surrounding sea water.

A small submarine produces, for example, at cruising speed heat loss on the order of 100 kW, so that about 2 cubic meters of warm cooling water are generated per hour if a temperature increase of 50 degrees Centigrade in the cooling water is tolerated. In large submarines, in particular in those with nuclear propulsion, the heat power is considerably higher and may reach the order of some 100 MW, which increases the amount of emitted warm cooling water correspondingly.

A submarine cruising in the diving mode therefore carries a trail of warm cooling water, which, because of its lower density compared to the surrounding cold sea water, rises to the sea surface. As a consequence, a submerged cruising submarine draws a track of heated up water behind itself at the sea surface.

On the other hand, it is known in the art to analyze minute temperature variations at the earth's surface using modern detection methods, e.g. using reconnaissance satellites which are specifically equipped for this purpose. Hence, even taking into account that the warm cooling water emitted by a submerged cruising submarine is whirled and thereby distributed by the propellers, and will be even more distributed, the deeper the submarine is submerged, or the further the heated water has to rise, respectively, to reach the sea surface, refined detection methods render it nevertheless possible to detect the heat track of a submerged cruising submarine at the sea surface.

Therefore, it is the object of the invention to provide a method or a device of the above mentioned kind, with which submerged cruising submarines can be accordingly camouflaged.

This object is achieved according to the above mentioned method by taking the heated up cooling water to a depth far below the submarine.

In accordance with the above mentioned submarine, the object of the invention is achieved by providing means to take the heated up cooling water to a depth far below the submarine.

In this way, the object of the invention is completely achieved. If, namely, the heated up cooling water is transferred to a sufficient depth below the sea surface, the then rising heated up cooling water is mixed with the surrounding cold sea water to such an extent that the temperature difference of the "diluted" cooling water reaching the surface to the surrounding sea water is only some mK, with the consequence that such a small temperature difference can no longer be detected, even with modern detection methods, or cannot be systematically differentiated from the natural temperature variations at the sea surface. The above-mentioned "heat track" of the submerged cruising submarine is smeared out in this way to such an extent that localization of the submarine is no longer possible in this way.

The object of the invention is further achieved by admixing an additive to the cooling water in such a way that the cooling water emitted by the submarine has a density which is greater than the density of the heated up cooling water without additive, preferably greater than the density of the sea water surrounding the submarine. To this end, a cooling water conduit is connected to a storage means containing an additive of high density and which is soluble in the cooling water. These measures have the advantage that the heated up cooling water is made denser, preferably denser than the surrounding colder sea water, in order that the heated up cooling water rises more slowly from the submarine and is therefore more intensely mixed with the cold sea water or that it even sinks downwards.

In a preferred variation of this embodiment the additive is common salt.

This measure has the advantage that the trace of the submerged submarine is also lost in other respects without remains since the common-salt-enriched heated up cooling water is diluted by the surrounding sea water and cannot chemically be distinguished from this afterwards, since it is known that sea water contains common salt in natural concentration.

In this variation of the invention it is particularly preferred to extract the common salt in the submarine from the surrounding sea water, which can be realized by connecting the storage means to a salt-enrichment installation which, in turn, is fed with sea water.

These measures have the advantage that the submarine is completely self-sufficient in performing the method according to the invention, since the common salt needed to sink the heated up cooling water may be extracted from the natural surroundings of the submarine and stockpiling is not necessary.

It is particularly preferred to admix the common salt to the cooling water in form of a salt solution since in this case the mixing of cooling water and common salt can be performed particularly easily by connecting pipes.

In a further variation of this embodiment the additive is caustic potash enriched with carbon dioxide.

This measure has the advantage that caustic potash has a particularly high density, so that with relatively small amounts of caustic potash a large amount of heated up cooling water may be caused to sink.

This variation may be further developed in that the caustic potash in the submarine is enriched by means of a closed-loop diesel propulsion. To this end, the storage means are connected to the closed-loop-diesel propulsion.

This measure, too, has the advantage that the submarine is largely self-sufficient, insofar as it is equipped with a closed-loop-diesel propulsion. It is known in the art that such propulsions dissolve the accumulating carbon dioxide in caustic potash which, as a 40 percent solution, has a density of already 1.4 grams per cubic centimeter.

In a further group of embodiments the heated up cooling water is lowered by mechanical means.

This measure has the advantage that the surroundings is not chemically influenced.

In an practical example of the embodiment, ballast containers are used which can be closed. To this end, the submarine according to the invention provides a filling installation where the heated up cooling water can be filled into ballast containers with a weight which is, when filled, greater than that of the amount of sea water displaced by them.

These measures have the advantage that the heated up cooling water can be transferred to a sufficient depth with great working reliability. Moreover, in case of corresponding available space inside the submarine, storage of filled containers is possible without difficulties, if sinking of the containers would just not be possible in a particular situation, e.g. a combat situation.

In a first variation of these embodiments the ballast containers are sunk to the sea bottom as lost goods.

This measure has the advantage that the heated up sea water is disposed of undetectably by removing the ballast containers from on board and that the disposal procedure is completed in this way.

In a further group of embodiments the ballast containers are, however, by means of a control connection opened at a predetermined depth and recovered on board the submarine after the heated cooling water has left. To this end, the filled and lowered ballast containers are connected to the submarine via a connecting line and at the ballast containers a remote-controlled opening mechanism is provided for.

These measures have the advantage that on the one hand pollution of the ocean floor with sunken ballast containers is avoided, on the other hand only comparably few ballast containers need be taken on board, since these can always be re-used.

It is particularly preferred that the ballast containers essentially consist of a plastic foil. This has the advantage that only very little storage space inside the submarine need be provided for.

A practical form of this embodiment is characterized by a filling installation that comprises a filling cylinder onto which a bellows-like endless hose is slipped, that the filling cylinder may be emptied in a cyclic fashion into a segment of the endless hose which is pulled off the filling cylinder and that means are provided to tie off the endless hose segment-wise.

This measure has the advantage that fast filling of the cooling water is possible in connection with minimum possible deployment of materials.

Finally, a further group of embodiments of the invention is particularly preferred where as means a flexible tube conduit extending from the submarine into the ocean depths is used.

This measure has the advantage that also in a towing mode the heated up cooling water may be disposed of continuously, whereby again the depth is chosen such that the heated up cooling water leaving the lower end of the tube conduit is sufficiently cooled on its way up to the surface.

In this context it is particularly preferred if an outlet head is located at the free end of the tube conduit.

This measure has on the one hand the advantage that the outlet head may act like a trailing anchor to keep the tube conduit permanently in a lowered position, on the other hand the outlet tube may, however, be designed in such a way that the heated up cooling water is emitted in all directions and/or in a whirled fashion to guarantee an optimum mixing with the surrounding cold sea water.

Further advantages result from the description and the accompanying drawings.

It is understood that the features mentioned above and those which are to be explained below are applicable not only in the respective given combinations but also in other combinations or by themselves without departing from the scope of the present invention.

Figure 2:
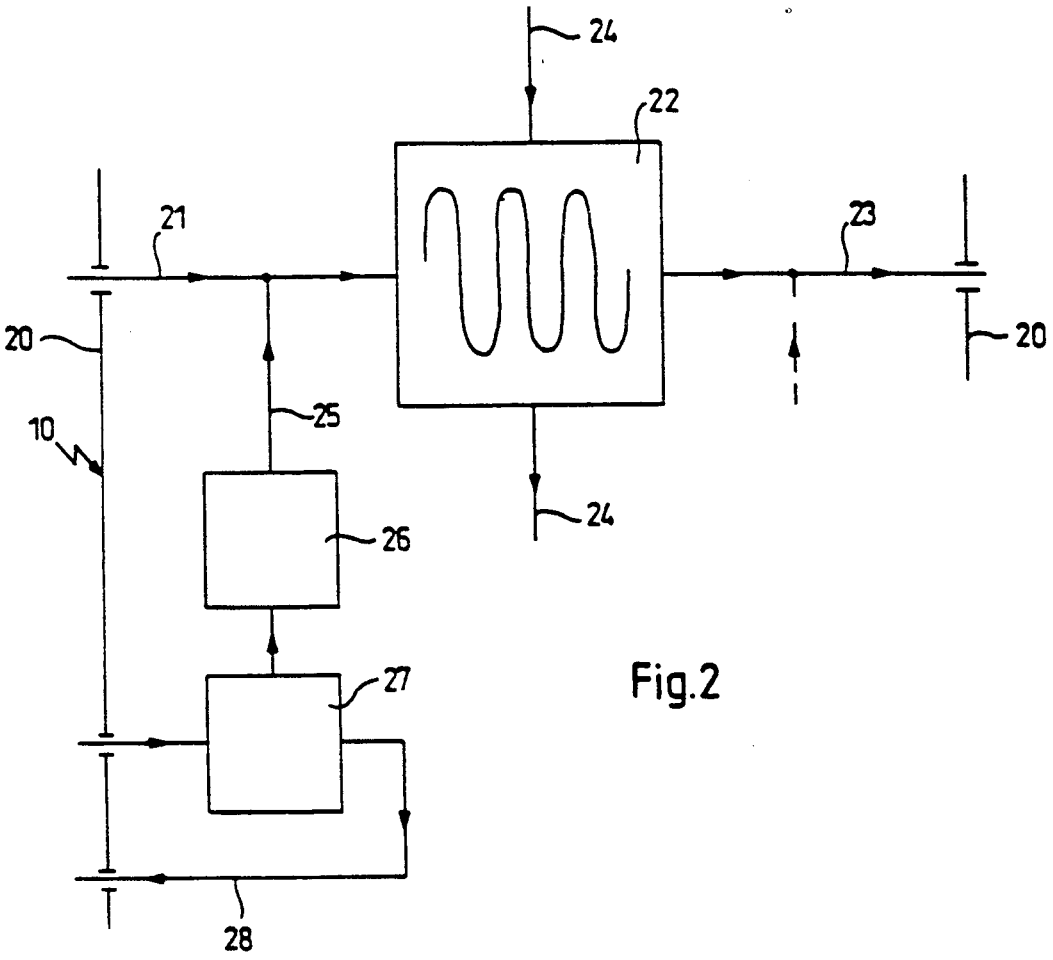
Figure 3:
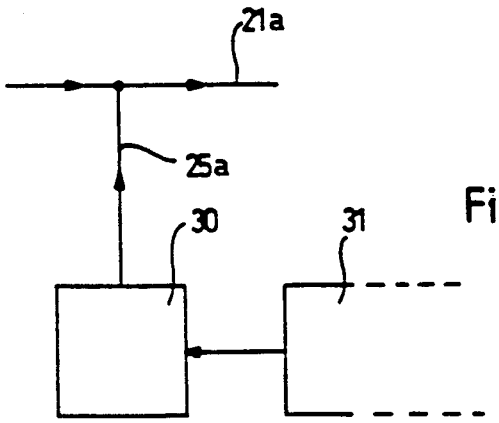
Figure 4:
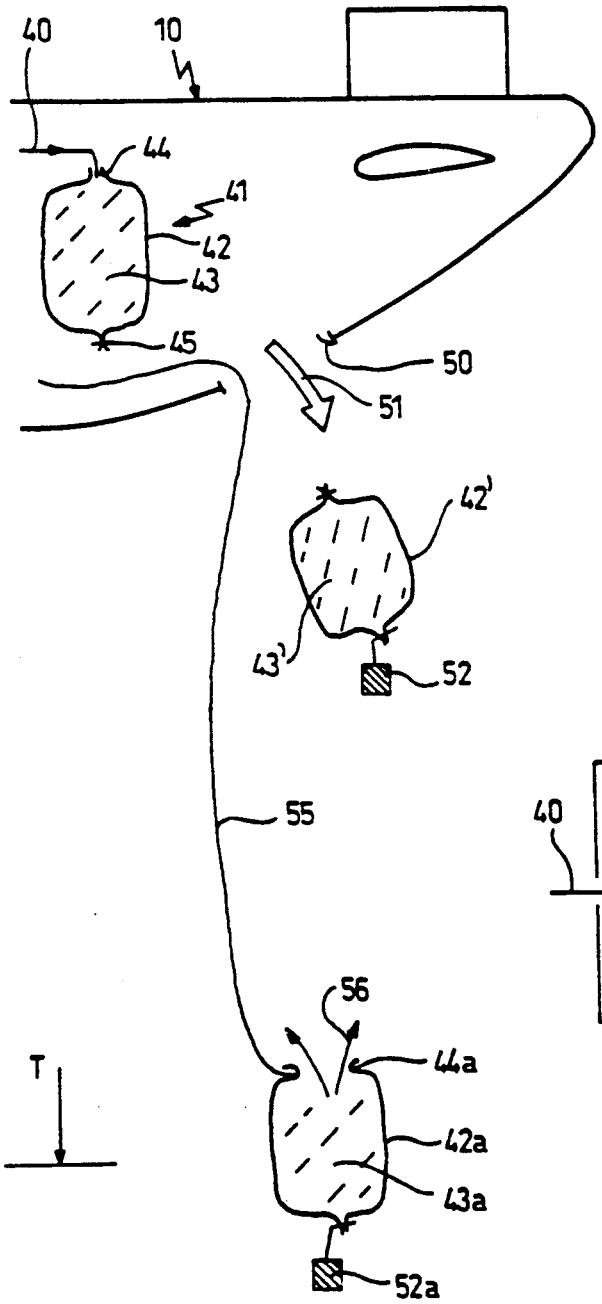
Figure 5:
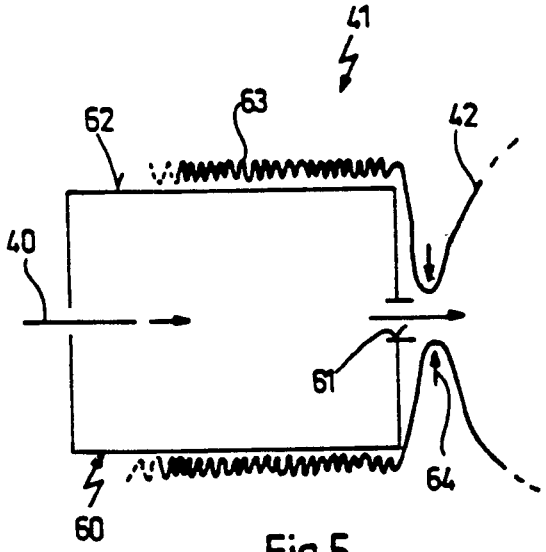
Figure 6:
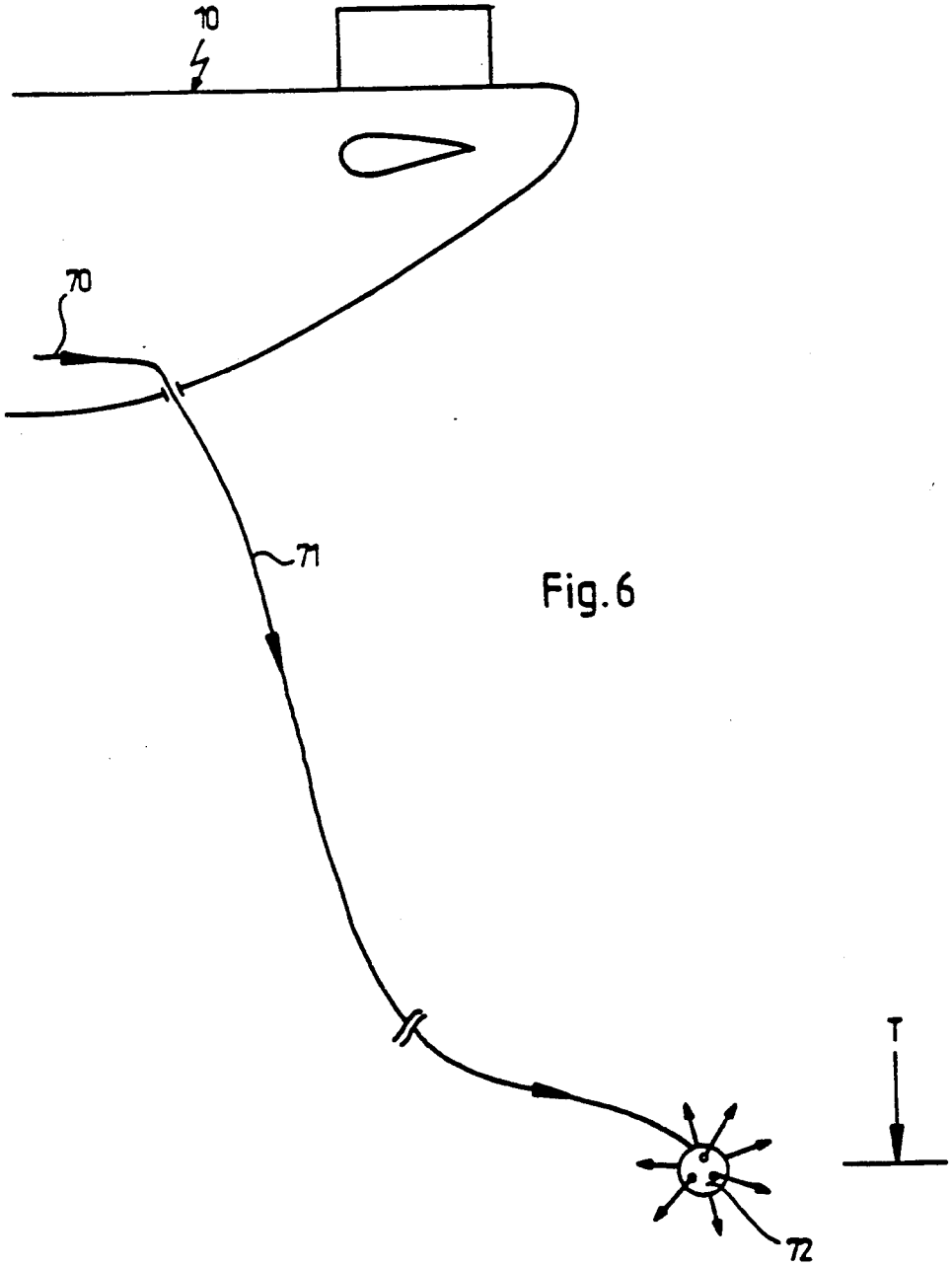

Embodiments of the invention are shown in the drawing and are explained in detail in the following description. Shown are:

FIG. 1 an extremely schematic representation of a submerged cruising submarine according to the state of the art, whose "thermal trace" is detectable by means of a reconnaissance satellite;

FIG. 2 a block diagram to explain a first embodiment of a device according to the invention to perform the method according to the invention;

FIG. 3 a variation of the block diagram of FIG. 2;

FIG. 4 again an extremely schematic representation to explain a further embodiment of a method according to the invention or an associated device, respectively;

FIG. 5 on an enlarged scale, a detail of FIG. 4;

FIG. 6 a representation similar to FIG. 4, but to explain yet another method and another device according to the invention, respectively.

In FIG. 1, numeral 10 indicates altogether a submerged cruising submarine, cruising in an ocean 16. The submarine 10 is equipped with a drive 11, indicated schematically. Drive 11 may be a conventional electric motor, a closed-loop diesel or a nuclear propulsion means.

The temperature of the sea 16 is labeled T1, whereas the temperature of submarine 10 is labeled T2. Temperature T2 is above the environmental temperature T1, since on the one hand drive 11 but also other aggregates of parts of submarine 10 produce heat loss. On the one hand, this lost heat is transferred to the surrounding sea water 16 via the outer hull of submarine 10, on the other hand, in general, a cooling circuit is used to cool drive 11, which cooling circuit comprises a heat exchanger connected to the sea 16.

In combination, this has the consequence that submarine 10 draws a trail 12 of heated up water behind itself. The temperature of this trail 12 is T1 T, wherebT indicates an excess temperature , which is smaller than the difference T2−T1 and which moreover decreases spatially with distance from submarine 10, but also as a function of time.

As a consequence of trail 12 of heated up water, at the surface 13 of sea 16, an area A is formed whose temperature is measurably higher than that of the surrounding sea 16.

By means of a reconnaissance satellite 14 by taking an appropriate bearing 15 this excess temperature of area A can be recognized and thereby submarine 10 can be localized.

In order to camouflage submarine 10 against the possibility to be localized explained in FIG. 1, methods and devices can be used as described in the following in connection with FIGS. 2 to 6.

In FIG. 2 label 20 indicates the outer hull of submarine 10. A cooling water inlet conduit 21 is fed through outer hull 20 and reaches a heat exchanger 22. From the outlet of said heat exchanger a cooling water outlet line 23 leads again through hull 20 to the surroundings of submarine 10. A cooling circuit 24 of the drive of submarine 10 is connected to the cross-branch of heat exchanger 22 as is, in and of itself, known in the art.

A conduit stub 25 leading to storage means 26 for salt solution is connected to cooling water inlet conduit 21. Salt solution storage means 26 is, in turn, connected to a salt enrichment installation 27 which is connected to the surroundings of submarine 10 via a circulating sea water conduit 28.

Salt solution storage means 26 contain a concentrated salt solution, which can be added to the entering cooling water in the cooling water inlet conduit 21 via conduit stub 25. It is understood that this is also possible in the area of cooling water outlet conduit 23, as indicated there by a dashed line.

If salt solution is added to the cooling water as described, the density of the common salt enriched cooling water is increased, since, as is known in the art, a salt solution becomes denser the higher the salt concentration.

Salt solution storage means 26 may contain an amount of salt stored at the beginning of the journey, it is, however, preferred to produce salt during the journey of submarine 10 by means of salt enrichment 27 from the surrounding sea water, since in this case the submarine is in this respect self-sufficient.

If the cooling water which has in this way been enriched with common salt emerges again from cooling water outlet conduit 23 to the surroundings, it sinks from submerged submarine 10 downwards because of its higher specific weight, where by means of diffusion it becomes gradually more equal to the surrounding sea water, with respect to its salt concentration as well as to its temperature.

In this respect it is not absolutely necessary to adjust the salt concentration to such a high value that the cooling water sinks downwards from submarine 10, sometimes, in particular in rough sea, it may be sufficient to slow down the ascent of the heated up cooling water to the sea surface sufficiently, if, in particular in rough sea, it is ensured that a sufficient mixing of the heated up cooling water with the surrounding cold sea water is effected by the movement of the sea.

FIG. 3 shows a variation of the set up according to FIG. 2. In the embodiment of FIG. 3, a caustic potash storage means 30 is connected to loading conduit 25*a*, said storage means being, in turn, connected to a closed-loop diesel drive 31 of submarine 10.

It is known in the art that in a closed-loop diesel drive the carbon dioxide CO2 which is produced by combustion is dissolved in caustic potash KOH, whereby the caustic potash attains a considerably higher density than water by saturation with KHCO3. For example, 40% solution of caustic potash has a density of about 1.4 grams per cubic centimeter.

What had been mentioned above in connection with FIG. 2 is also true for the embodiment of FIG. 2, namely, that the caustic potash enriched heated up cooling water either sinks down off the submarine 10 after leaving the cooling water outlet or that it is at least sufficiently slowed down in its upward ascent.

In the embodiment of FIG. 4, in submarine 10 a cooling water outlet line is connected to a filling installation 41, further details of which are explained further below in connection with FIG. 5.

In the filling installation 41, containers 42 are filled with heated up cooling water 43. In the embodiment of FIGS. 4 and 5, containers 42 are realized as bags made from plastic foil, which are filled at their upper ends 44 and which are already closed at their lower ends 45. After filling container 42, upper end 44 is also closed and container 42 may be lowered by an opening 50 of submarine 10 in the direction of arrow 51 downwards. Label 42' indicates a container lowered down from submarine 10, which is provided at its lower end with a ballast weight 52, in order that container 42' sinks down in spite of the contained warm cooling water 43'.

Containers 42' may then be dropped freely, so that these are sunk to the sea bottom as lost goods.

However, in another variation, which is also represented in FIG. 4, a control conduit 55 or, respectively, a connection line or the like is provided to grip and to tow container **42*a* at its upper end 44*a*. By means of remote control, e.g. a cable connection via control conduit 55 or via a wireless ultra-sound connection or the like, an opening mechanism at the upper end 44*a* of container 42*a*, which is not explicitly shown in FIG. 4, may be actuated to open container 42*a* in order that warm cooling water 43*a* may escape upwards from container 42*a* as indicated by arrows 56 in FIG. 4. In this case, too, container 42*a* is obviously equipped with a ballast weight 52*a*, in order to lower container 42*a*** to a predetermined depth T.

After self-emptying of container **42*a* it may again be taken on board the submarine 10 by retracting control conduit 55**, and be refilled again.

FIG. 5 shows further details of filling installation 41. In can be seen that a filling cylinder 60 is provided for which is connected to cooling water outlet line 40 from the left side, whereas at the opposing front end of filling cylinder 60 a central outlet pipe 61 is situated. A bellows-like endless hose 63 is slipped onto the periphery 62 of filling cylinder 60. By means of a device not shown in FIG. 5, endless hose 63 can segment-wise be pulled off periphery 62 to the right and there be tied off as indicated by arrows 64.

In this way, it is possible to fill respective predetermined segments of endless hose 63 with heated up cooling water, whereby the filled segments of endless hose 62 are tied off at both ends.

Finally, FIG. 6 shows a further embodiment of the invention where a cooling water outlet conduit 70 is fed through the outer hull of submarine 10 to the outside where it crosses over into a flexible tube conduit 71. Flexible tube conduit 71 reaches down with its lower end to the predetermined depth T and is there provided with an outlet head 72, which serves at the same time as ballast or trailing anchor, respectively.

Outlet head 72 is equipped with nozzles and/or baffle plates and the like in such a way that the heated up cooling water flows off the outlet head 72 in all directions and that it can optimally be mixed with the surrounding cold sea water.

We claim:

1. A method of operating submarines submerged in a surrounding sea, the method including a step of using sea water as cooling water to remove excess heat generated by the submarine during operating thereof, and including a further step of transferring the resulting heated-up cooling water into said surrounding sea, wherein said transferring step comprises the step of transferring said heated-up water to a depth far below said submarine.

2. The method of claim 1, wherein said heated-up water is transferred to said depth by mechanical means.

3. The method of claim 2, wherein said mechanical means is designed as a flexible tube conduit.

4. The method of claim 2, wherein said mechanical means are designed as closeable ballast containers.

5. The method of claim 4, wherein said ballast containers are sunk to a sea bottom as lost goods.

6. The method of claim 4, wherein said ballast containers are opened at a predetermined depth by means of a control connection, said ballast containers being subsequently taken on board the submarine after the heated-up cooling water has escaped therefrom.

7. The method of claim 4, wherein said ballast containers essentially consists of a plastic foil.

8. The method of claim 7, wherein said ballast containers are produced by cyclically filling and tying off an endless hose.

9. A method of operating submarines submerged in a surrounding sea, the method including a step of using sea water as cooling water to remove excess heat generated by the submarine during operation thereof and including a further step of transferring the resulting heated-up cooling water into said surrounding sea, wherein said transferring step comprises the step of adding an additive to said cooling water such that said cooling water, when emitted from said submarine, has a density higher than the density of said heated-up cooling water without said additive.

10. The method of claim 9, wherein said additive is common salt.

11. The method of claim 10, wherein said common salt is produced on board said submarine from said surrounding sea water.

12. The method of claim 10, wherein said common salt is added to said cooling water in the form of a salt solution.

13. The method of claim 9, wherein said additive is a caustic potash solution, enriched with carbon dioxide.

14. The method of claim 13, wherein said caustic potash solution is enriched inside said submarine by means of a closed-loop diesel propulsion system in which carbon dioxide gases are removed from diesel exhaust gases.

15. A submarine having a cooling system in which, during operation of said submarine, when submerged in a surrounding sea, sea water is used as cooling water to remove excess heat generated by operation of the submarine and as a result the cooling water is heated up, and having transferring means for transferring said heated-up cooling water to said surrounding sea at a depth far below said submarine.

16. The submarine of claim 15, wherein a cooling water outlet conduit is connected to a flexible tube conduit extending from said submarine into said depth.

17. The submarine of claim 16, wherein an outlet head is provided at a free end of said tube conduit.

18. The submarine of claim 15, comprising a filling installation for drawing off said heated-up cooling water into ballast containers, the weight of which, when filled with said heated-up cooling water, is larger than that of an amount of surrounding sea water being displaced by said ballast containers.

19. The submarine of claim 18, wherein said ballast containers are made from a plastic foil.

20. The submarine of claim 18, wherein filled and released ballast containers are connected to said submarine via a connecting line, a remote control opening mechanism being provided for on said ballast containers.

21. The submarine of claim 18, wherein said filling installation comprises a filling cylinder onto which a bellows-like endless hose is slipped, a filling cylinder being designed to be emptied in a cyclic fashion into a segment of said endless hose being pulled off the filling cylinder, and means being provided for tying off said endless hose in a segment-wise manner.

22. A submarine having a cooling system in which, during operation of said submarine, when submerged in a surrounding sea, sea water is used as cooling water to remove excess heat generated by operation of the submarine and as a result the cooling water is heated up, and having transferring means for transferring said heated-up cooling water to said surrounding sea, wherein said transferring means comprises a cooling water conduit connected to storage means containing a higher density additive which is soluble in said cooling water.

23. The submarine of claim 22, wherein said additive is common salt.

24. The submarine of claim 23, wherein said storage means is connected to a salt enrichment installation being fed with water from said surrounding sea.

25. The submarine of claim 22, wherein said additive is caustic potash solution.

26. The submarine of claim 25, wherein said storage means is connected to a closed-loop diesel propulsion system of said submarine.

* * * * *